US005096511A

United States Patent [19]

Fetting

[11] Patent Number: 5,096,511

[45] Date of Patent: Mar. 17, 1992

[54] METHOD AND A DEVICE FOR THERMAL SURFACE-HARDENING OF METAL WORKPIECES

[75] Inventor: Rudolf Fetting, Bremen, Fed. Rep. of Germany

[73] Assignee: HPO Hanseatische Prazisions-und Orbittechnik GmbH, Bremen, Fed. Rep. of Germany

[21] Appl. No.: 475,782

[22] Filed: Feb. 6, 1990

[30] Foreign Application Priority Data

Feb. 8, 1989 [DE] Fed. Rep. of Germany ..... 3903616

[51] Int. Cl.[5] ..... C21D 1/09

[52] U.S. Cl. ..... 148/152; 148/903; 148/904; 219/121.78

[58] Field of Search ..... 148/4, 13, 903, 904, 148/152, 145; 219/121.73, 121.74, 121.78

[56] References Cited

U.S. PATENT DOCUMENTS

| | | | |
|---|---|---|---|
| 4,197,157 | 4/1980 | Haggerty | 156/620 |
| 4,456,811 | 6/1984 | Hella et al. | 148/11.5 R |
| 4,924,062 | 5/1990 | Zurcher | 148/903 |

FOREIGN PATENT DOCUMENTS

| | | | |
|---|---|---|---|
| 0281686 | 9/1988 | European Pat. Off. . | |
| 2326296 | 12/1974 | Fed. Rep. of Germany . | |
| 0249428 | 9/1987 | Fed. Rep. of Germany . | |
| 0149712 | 8/1985 | Japan | 148/903 |

OTHER PUBLICATIONS

*Metals Handbook*, 9th Edition, vol. 4, pp. 507-517, 8-1-0-82.

*Primary Examiner*—S. Kastler

*Attorney, Agent, or Firm*—Merchant, Gould, Smith, Edell, Welter & Schmidt

[57] ABSTRACT

The invention concerns a method for thermal surface-hardening of metal workpieces, in particular of shaft ends, by means of a laser source with which, if necessary, with relative movement of workpiece and laser source, the workpiece surface to be hardened is heated sectionally by laser radiation. In accordance with the invention, the laser radiation is irradiated essentially uniformly in a hardening zone that extends in a principal direction, at least approximately over the entire workpiece surface to be hardened.

Furthermore, the invention concerns a device for thermal surface-hardening of metal workpieces, in particular shaft ends, with a laser source for furnishing laser radiation onto the workpiece surface to be hardened and, if necessary, with contrivances for the relative movement of laser source and workpiece; mirror devices provided in accordance with the invention convert the laser radiation given off by the laser source into a flat beam and direct it toward a hardening zone that extends in a principal direction, at least approximately over the entire workpiece surface to be hardened.

Achieved in this manner is an essentially homogeneous heating of the workpiece surface that excludes variations in hardness due to excessive or deficient hardening.

21 Claims, 1 Drawing Sheet

METHOD AND A DEVICE FOR THERMAL SURFACE-HARDENING OF METAL WORKPIECES

DESCRIPTION

Figure 1:
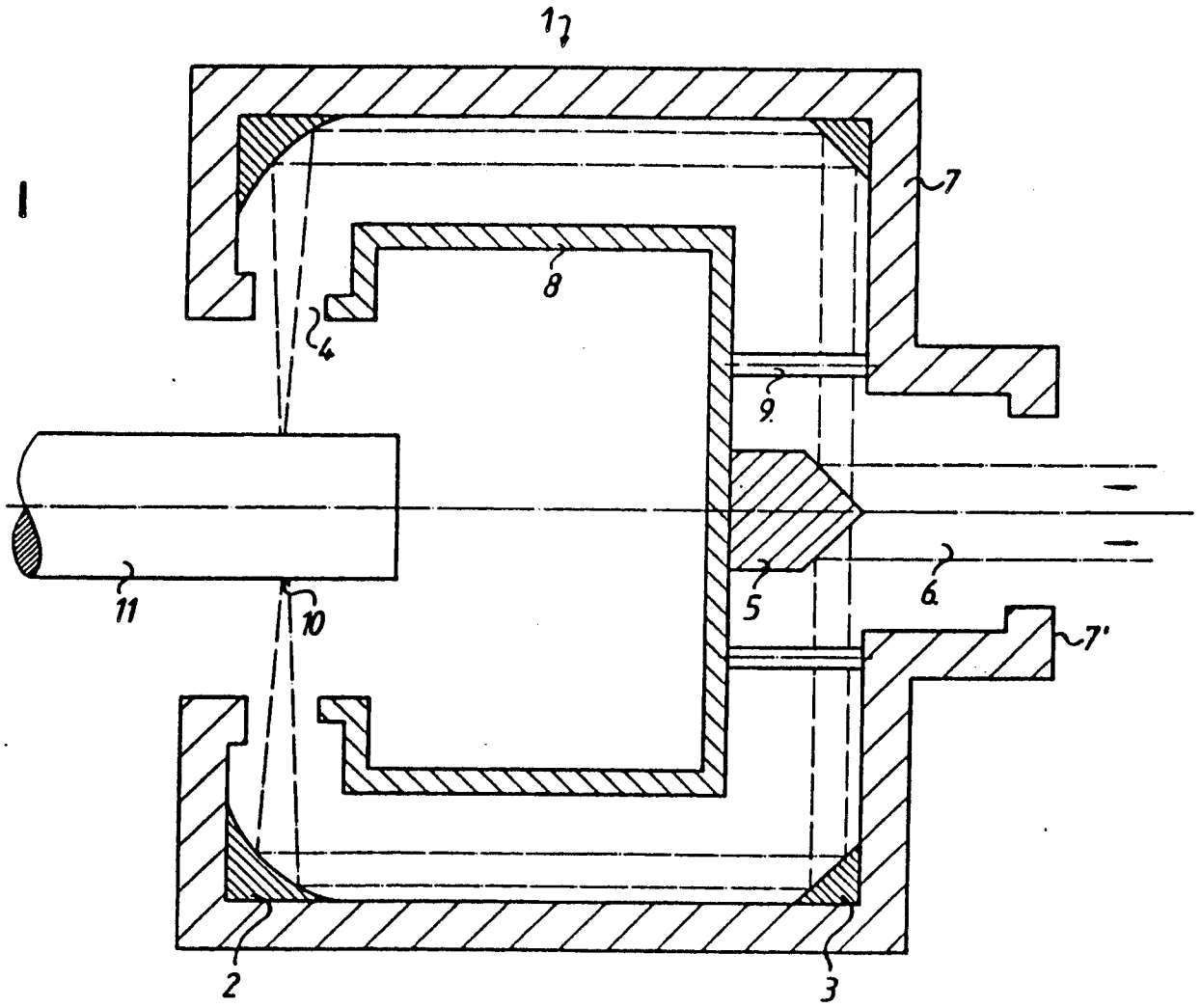

The invention concerns a method and a device for thermal surface-hardening of metal workpieces.

Thermal surface-hardening of metal workpieces, in particular shaft ends, is most often utilized when the workpieces are too large for an economical hardening in an oven, or a penetration-hardening lasts too long. Therefore, developed for hardening shaft ends have been systems by means of which the surface is heated and hardened by a focused laser beam.

In systems of this type, the workpiece (shaft end) is rotated and simultaneously pushed forward perpendicularly to the direction of rotation; in so doing, the punctiform laser beam describes a helical or lamellar path on the periphery of the shaft end and generates a corresponding zone of hardening. In so doing, there is further hardening in the overlapping regions; on the other hand, heating can be insufficient between the turns of the path. Overall, obtained is a surface-hardened shaft end that displays periodic inhomogeneities of surface hardness.

The object of the invention is to outline a method and a device of the initially-mentioned sort that enable a more homogeneous surface hardening.

One particular advantage of the invention lies in the fact that achieved in a zone of hardening, instead of a punctiform heating of the surface, is a uniform heating, with the zone of hardening extending in a principal direction, at least approximately over the entire workpiece surface to be hardened. If this heating zone can not already cover the entire section to be hardened, it is possible, by means of a relative movement of workpiece and laser source, to cause the zone of hardening to wander over the entire workpiece surface to be hardened, until the entire surface has been uniformly hardened. Excessive hardenings as well as insufficient hardenings are avoided.

Advantageous embodiments of the method and of the device are defined in the subclaims.

In particular for cylindrical shaft ends, one will advantageously provide for the hardening zone to run ring-fashion over the periphery, so that a simple axial forward feed of the shaft enables a uniform surface hardening of the entire shaft end.

In doing this, it is advantageously possible to provide for keeping the mirror devices serving for irradiating the laser beam into the hardening zone under a protective gas, which prevents contamination.

For many hardening applications, the laser beam need not be absolutely focused; therefore, the measures in accordance with the invention can be used without further ado for a large range of workpiece diameters. The desired hardness can be set by coordinating the workpiece dimensions, rotation and translation of the workpiece and laser power, usually a $CO_2$ laser, with one another. Since in the case of the device in accordance with the invention the ring mirror that reflects the laser beam onto the hardening zone is easily replaced, it is possible to cover additional diameter ranges.

Explained in more detail in the following with the aid of the accompanying drawing is a preferred form of embodiment of the invention. The drawing shows a schematic cut view of a hardening head for hardening a shaft end. The hardening head 1 has, for example, an essentially cylindrical outer housing 7 in which are disposed mirror devices 2, 3, 5.

The outer housing 7 has an opening through which can be introduced into the inside of the hardening head 1 a shaft end 11 that is to be surface-hardened.

Located opposite to this opening, the outer housing 7 has another opening 7' through which a laser beam 6 from a laser source (not shown) external to the hardening head 1 enters in the direction of the arrow. Like the drawing shows, the laser beam 6 incides along the principal axis of the shaft end 11.

Located inside the outer housing 7 is an inner housing 8 that is attached to the outer housing 7 by means of support rods 9. Remaining between the inner housing 8 and the outer housing 7 is a space in which are arranged the mirror devices 2, 3, 5, that are to be described in more detail. Capable of being introduced into this intermediate space is a protective gas that prevents contamination of the mirror devices.

The mirror devices include first a cone mirror 5 that is attached to the inner housing 8 such that it lies with its cone tip on the principal axis of the shaft end 11 and, therewith, also of the laser beam 6. The cone mirror 5 turns its cone tip toward the laser source (not shown), which is constructed as a commercial type $CO_2$ laser source, and that can be flange-mounted at the opening 7' of the outer housing.

The laser beam 6 strikes against the cone mirror 5 and is deflected outwardly on its conical periphery. In the example of embodiment, the cone angle of the cone mirror 5 is selected such that this deflection occurs at a right angle. The laser beam, after deflection by the cone mirror 5, forms a flat, disk-shaped area perpendicular to the mentioned principal axis.

Located farther radially outwardly from the principal axis, inside the outer housing 7, is a ring-shaped deflecting mirror 3 having a flat mirror surface, which is inclined toward the principal axis at a 45° angle. The beam coming from the cone mirror 5 is deflected by the deflecting mirror 3 such there arises a cylindrical hollow beam. This latter runs through the intermediate space between outer housing 7 and inner housing 8, in the direction toward the shaft end 11. The hollow beam strikes against an aspherical ring mirror 2 that is likewise disposed inside the outer housing 7 and deflects the beam inwardly toward the shaft end 11. In so doing, the beam converges such that it can strongly heat the ring-shaped peripheral region of the shaft end 11, in which it falls. Formed by this means in this peripheral region is a hardening zone 10 that extends in circularly closed fashion over the entire periphery of the shaft end. At each spot of the hardening zone, the impinging radiation intensity, and therewith heating, is equal, since the mirror devices 2, 3, 5 divide and deflect the impinging laser beam 6 completely uniformly.

Near the opening allowing entrance of the shaft end 11 into the hardening head 1, outer housing 7 and inner housing 8 almost come together, so that a ring gap 4 is formed. The converging beam from the aspherical ring mirror 2 falls onto the hardening zone through this ring gap 4. Formation of this relatively narrow ring gap 4 has the effect of permitting flowing a protective gas through the intermediate space between the outer housing 7 and the inner housing 8, in order to protect the mirror devices 2, 3, 5 against contamination, without, on the other hand, consuming too much protective gas. Gas losses can be further limited by providing the ring gap 4, in a manner not shown, with a seal, for example a lamellar seal that opens when turning on the device, and therewith flowing protective gas through, and otherwise remaining closed.

In operation, the shaft end 11 is pushed in the direction of its principal axis and simultaneously into the hardening head 1, so that the hardening zone 10, starting out from the free end of the shaft, wanders over the entire surface region of the shaft end 11 that is to be hardened. The forward-feed speed of the shaft end 11 is selected such that, taking into consideration the power of the laser source, desired hardening is achieved.

The support rods 9, which join inner housing 8 and outer housing 7, can consist of material that is not pervious for the infrared radiation of the $CO_2$ laser. This could lead to inhomogeneities because part of the course of the beam is shaded. However, this can be easily compensated by slowly turning the shaft end 11 in addition to its forward feed movement.

Alternatively to this, a shadow-free hardening zone can be obtained by constructing the ring-shaped deflection mirror 3 and the aspherical ring mirror 2 with periodic deformations and/or shape variations which, in number, position and form are coordinated to the support rods 9 and avoid shadow formation. In this case, the shaft end 11 would not have to be turned.

Another alternative for avoiding inhomogeneities in the hardening zone consists of constructing the connecting elements between outer housing 7 and inner housing 8 of infrared-pervious material; for example, instead of the support rods 9, it is possible to use a cylindrical spacer and support ring made of IR-pervious material (for example silicon).

It is understood that the device in accordance with the invention can be modified without further ado in several parts. The ring mirrors can be constructed to be exchangeable; in particular, by exchanging the aspherical ring mirror for another one with a different mirror surface curvature, it is possible to set up the degree of convergence of the laser beam for other workpiece diameters. Additionally, the beam course need not necessarily display right-angle changes in direction at the cone mirror 5 and deflection mirror 3.

I claim:

1. Method for thermal surface-hardening of outer surfaces of metal workpieces by means of a laser source with which the workpiece surface to be hardened is heated sectionally by means of laser radiation having a solid circular cross-section, wherein the laser radiation is outwardly distributed by a cone mirror in a disk area about the axis of the cone mirror with the cone tip facing toward the laser source, and is reflected convergingly inwardly toward a hardening zone of the workpiece by a ring-shaped deflecting mirror means disposed in the disk area plane and inclined thereto for irradiating the laser radiation in an essentially uniform hardening zone that extends, in a principal direction, at least approximately over the entire outer workpiece surface to be hardened.

2. Method according to claim 1, wherein the hardening zone extends over the outer surface of the workpiece in closed-ring fashion.

3. Method according to claim 1, wherein relative movement of workpiece and laser source is generated, the direction of which is normal to the principal direction of the hardening zone.

4. Method according to claim 1, wherein the hardening zone is maintained under a protective gas.

5. Method according to claim 1, wherein the outer surface of the workpiece has a substantially circular cross-section.

6. Device for thermal surface-hardening of outer surfaces of metal workpieces with a laser source for delivering laser radiation having a solid circular cross-section and with mirror means for deflecting the laser radiation toward the workpiece surface to be hardened, wherein said mirror means comprises a cone mirror, with the cone tip facing toward the laser source, which distributes the laser radiation outwardly in a disk area about the axis of the cone mirror, and at least one ring-shaped deflecting mirror means disposed in the disk area plane inclined thereto, for reflecting the hollow beam convergingly inwardly toward the hardening zone of the outer surface of the workpiece.

7. Device according to claim 6, wherein the outer surface of the workpiece has a substantially circular cross-section.

8. Device according to claim 6, wherein said deflecting mirror means comprises a first ring-shaped deflecting mirror disposed in the disk area plane and inclined thereto which transforms the laser radiation into a hollow beam, and a second ring-shaped deflecting mirror which reflects the hollow beam convergingly inwardly toward the hardening zone of the outer surface of the workpiece.

9. Device according to claim 8, wherein the laser source is arranged relative to the workpiece such that the laser radiation travels along a longitudinal axis of the workpiece, and further wherein a longitudinal axis of the cone mirror is coaxial with the workpiece axis.

10. Device according to claim 9 wherein the cone mirror has a cone angle such that the laser radiation defines a disk area about the workpiece axis after deflection by the cone mirror, and wherein the first ring-shaped deflecting mirror is flat and the second ring-shaped deflecting mirror is aspherical.

11. Device according to claim 9, further comprising means for the relative movement of workpiece and the mirror means along a longitudinal workpiece axis, as well as means for the relative rotation of the workpiece and mirror means about the longitudinal workpiece axis.

12. Device according to claim 6, wherein the mirror means are disposed in an outer housing including an opening for the at-least-partial entry of the workpiece.

13. Device according to claim 12, wherein the outer housing includes an opening for entry of the laser radiation from the laser source that is disposed outside the outer housing.

14. Device according to claim 12, further comprising means for feeding a protective gas into the outer housing.

15. Device according to claim 12, further comprising an inner housing provided inside the outer housing, inwardly from the radiation path, which with the outer housing forms a ring gap near the hardening zone.

16. Device according to claim 15, further comprising means for feeding a protective gas into the space between outer housing and inner housing.

17. Device according to claim 16, wherein the ring gap is provided with a seal which in the case of non-operation of the hardening device blocks off the ring gap and opens it with operation of the hardening device.

18. Device according to claim 15, wherein the cone mirror is attached to the inner housing.

19. Device according to claim 15, wherein the inner housing is attached to the outer housing by elements crossing the path of the beam.

20. Device according to claim 19, wherein the elements consist of a material that is pervious for the laser radiation and include a spacer and support ring made of high infrared radiation-pervious material.

21. Device according to claim 19, wherein the elements are constructed of material that is substantially not pervious to the laser radiation, the mirror means include periodic deformations whose number and position correspond to those of the elements and that compensate for the imperviousness of the elements.

* * * * *